United States Patent [19]

Roberts et al.

[11] 4,052,831

[45] Oct. 11, 1977

[54] PANEL BUILDING CONSTRUCTION AND METHOD, AND CLIP

[76] Inventors: Frank William Roberts, 380 E. 7500 S., Midvale, Utah 84047; Richard Allen Roberts, 2551 Milo Way; Waldo Calvin Roberts, 4906 Regency, both of Salt Lake City, Utah 84117; Robert Howard Blanpied, 519 Barnard, Centerville, Utah 89014

[21] Appl. No.: 691,609

[22] Filed: June 1, 1976

[51] Int. Cl.[2] ..... E04F 13/00

[52] U.S. Cl. ..... 52/309.8; 52/363; 52/509; 52/714; 52/715; 52/746; 52/391

[58] Field of Search ..... 52/362, 483, 489, 509, 52/713, 714, 715, 548, 361, 679, 363, 391, 309.8, 363, 746

[56] References Cited

U.S. PATENT DOCUMENTS

| | | | |
|---|---|---|---|
| 2,218,273 | 10/1940 | Wilhoyte | 52/362 |
| 2,325,766 | 8/1943 | Gisondi | 52/361 X |
| 2,851,740 | 9/1958 | Baker | 52/489 X |
| 3,187,389 | 6/1965 | Anderson | 52/714 X |
| 3,343,329 | 9/1967 | Pohutsky | 52/362 X |
| 3,401,494 | 9/1968 | Anderson | 52/679 X |
| 3,510,391 | 5/1970 | Bolster | 428/314 |
| 3,511,008 | 5/1970 | Grems et al. | 52/548 X |

FOREIGN PATENT DOCUMENTS

| | | | |
|---|---|---|---|
| 571,352 | 2/1959 | Canada | 52/489 |

*Primary Examiner*—Alfred C. Perham
*Attorney, Agent, or Firm*—Mallinckrodt & Mallinckrodt

[57] ABSTRACT

Composite panels, each having a rigid board facing, made from gypsum, concrete, wood, or fibrous material, backed by a layer of foamed plastic insulating material whose reverse face is protected by a highly reflective, flame-retardant, moisture-vapor-proof material applied thereto, are held together edge-face to edge-face in building construction by special retaining clips which secure the panels to supporting structure, such as exterior, load-bearing walls, roof, or ceiling, and also serve to guide installation of the panels so that flush registry is assured without time consuming care in installing an additional panel relative to one already in place. The clip has flanges extending perpendicularly from lateral edges of a web strip whose width depends upon the use intended and the panel thickness. A flange along one edge of the web strip is adapted to be secured directly to the supporting structure. Flanges extending mutually oppositely along the other edge of the web strip are adapted to respectively penetrate the interfaces between insulating material and rigid board facings of mutually adjoining panels received by the clip. The outer extremity of the securement flange is formed as a ramp for deflecting a to-be-installed one of the mutually adjacent panels into proper flush position with respect to the one already installed. As an optional feature, the underside of the securement flange can also be provided with projections adapted to serve as spacers with respect to the structure against and to which it is secured.

9 Claims, 7 Drawing Figures

PANEL BUILDING CONSTRUCTION AND METHOD, AND CLIP

BACKGROUND OF THE INVENTION

1. Field

The invention pertains to building construction in which mechanical clips are utilized to fasten composite insulating panels to one another, edge-face to edge-face, and to supporting building structure.

2. State of the Art

The advantages of foamed plastic insulation are well known. It has been common practice to apply sheets of foamed plastic insulation, usually foamed polyurethane or polystyrene, to concrete, steel, and masonry walls, ceilings, and roofs by means of an adhesive and/or mechanical fasteners. To finish the wall and provide a protective shield for the foamed plastic insulation, gypsum wallboard panels have been adhesively secured to exposed faces of the foamed plastic sheets. Furring strips, studs, or undersized studs, have also been attached to the concrete, steel, or masonry walls, with the foamed plastic sheets and wallboard panels nailed and/or glued to the furring strips or studs.

U.S. Pat. No. 3,401,494 discloses a wall construction in which sheets of foamed plastic insulation are secured to masonry or concrete walls using elongate, channel-shaped fasteners that are pressed into the sheet of insulation at spaced intervals, so that web portions of the respective fasteners are flush with the exposed faces of the sheets. Nails or power-driven pins are passed through the fasteners and into the wall. Gypsum wallboard panels are then positioned over the respective sheets of insulation, and screws are driven through the panels and into the web of the fasteners.

U.S. Pat. No. 3,510,391 discloses a composite insulation board formed by a foamed plastic sheet laminated directly to a perlite insulation board. The advantage of such a one-piece panel is that it can be applied to a supporting structure in one step. However, if nails are used to secure the panel to the structure, some deformation of the foamed insulation portion of the panel occurs, which decreases the effectiveness of the foamed insulation in the vicinity of the nails. In addition, the nails that penetrate the insulation material readily transmit heat through the composite panel, thereby further decreasing its insulating properties.

There is no provision in either of the systems described in U.S. Pat. Nos. 3,401,494 and 3,510,391 for providing flush surface alignment between adjoining panels, or for providing an air space between the foamed plastic sheet and the supporting structure to which it is secured.

A composite panel has been made by adhesively bonding a preformed sheet of foamed plastic to a gypsum wallboard panel. To avoid the problem of nailing such a composite panel to a wall, mechanical clips have been used. Each clip has had flanges extending perpendicularly from lateral edges of a flat web strip to receive and secure adjoining panels edge-face to edge-face, but not necessarily aligning the adjoining panels for flush registry of their exposed surfaces. A flange along one of the lateral edges of the web strip has been nailed to the supporting structure, and prong flanges, extending mutually oppositely from the other lateral edge of the web strip, have penetrated the foamed plastic insulation of the adjoining panels, but not necessarily at the interface of the rigid board and the foamed sheet, and have served to secure them in place without nailing through them. By very careful hand placement of the panels with respect to the foam-penetrating flanges of the clip members, an air space has been formed between the supporting wall and the panels, and the panels have been positioned to obtain a rough degree of flush surface alignment relative to each other. However, proper installation of the panels has been nearly impossible when the supporting structure is a concrete wall, due to deformation of the clip member by the shock of the powder-driven attachment tool which must be used to attach the clip to the concrete wall. In those installations wherein conventional powered tools can be used instead of power driven tools, obtaining proper alignment of the panels has been time consuming and has involved considerable expense for labor.

SUMMARY OF THE INVENTION

In accordance with the present invention, an improved construction and method along the lines of the last prior art approach indicated above are provided. Similar composite panels are secured to supporting structures and are held in place, edge-face to edge-face, by special retaining clips, which serve to accurately space the panels from the supporting structure. The composite panels are installed quickly and easily, and flush registry of the broad panel faces is assured so that the finished surface will be smooth, without irregularities in its contour.

The special retaining clips are also similar to those of the last prior art approach indicated above, each comprising a flat web strip having flanges extending perpendicularly from lateral edges thereof to provide a securement flange, which can have a flat, continuous shape or can comprise one or more prongs, at and along one edge of the web strip and panel-anchoring flanges comprising prongs extending mutually oppositely at and along the other edge of the web strip. The width of the web strip depends upon the thickness of the foamed plastic sheet or the rigid board facing, depending on how the panels are installed in a particular construction, i.e. whether with the foamed plastic layer or with the rigid board facing, usually gypsum board, being closest to the supporting structure. For those applications, as in wall construction, wherein the plastic foam side of the panel is adjacent to the supporting structure, the width of the web strip is commensurate with the thickness of the foamed plastic layer. However, for those applications, as in roof construction, wherein the rigid board facing is positioned adjacent to the supporting structure, the width of the web strip is commensurate with the thickness of such rigid board facing.

The significant thing about the retaining clip of the invention is the formation of a ramp at the outer extremity of the securement flange to direct edgewise installation of a to-be-positioned panel relative to one already positioned, while simultaneously effecting proper spacing of each panel from the supporting structure. The ramp guides the leading edge of the to-be-installed panel into exact position so that the panel-anchoring flanges of the retaining clip penetrate the foamed plastic layer exactly at its interface with the rigid board facing of the panel. The distance from the web to the inner side of the ramp formation; i.e. the length of the body portion of the securement flange, is at least as great or greater than the length of the prong or prongs of the anchor flange which extend from the web strip in the same direction as the securement flange. This permits a panel which is being installed to slide up the ramp and attain its proper elevation with respect to previously installed panels just before the prong of the panel anchoring flange penetrates the panel.

The ramp formation is advantageously provided as a sheet metal clip by bending the outer extremity of the securement flange outwardly. Optionally, spacer tabs can be punched outwardly from the body of the securement flange, so that the entire body portion of such flange is properly spaced from the supporting structure and is substantially parallel therewith, thereby providing flat installation surfaces for the to-be-installed panel. The ramp and the spacer tabs insure a small air space between the composite panel and the supporting structure. The spacer tabs also provide a cushioning action which, as will be explained more fully hereinafter, absorb the shock exerted on the clip when it is attached to the supporting structure with powder-driven attachment tools.

In carrying out the method of the invention, one or more of the clips are secured directly to the supporting structure by nailing or otherwise fastening the securement flange thereof against the exposed face of the supporting structure. The to-be-installed panel is then pushed edgewise into place, being deflected into proper position by the clip ramps, so the corresponding prong or prongs of the panel-anchoring flanges enter the foamed plastic layer of the panel at the interface of that layer and the rigid board facing. Additional clips are positioned at the opposite edgeface of this partially installed panel to secure that part of the panel in place and to receive the next panel to be installed, in a similar manner.

It has been found advantageous to use a construction adhesive together with the clips to secure the composite panels to the supporting structure. The adhesive is placed, either as a plurality of spots or a series of ribbons or beads, on the face of the to-be-installed panel which, when installed, will be adjacent to the supporting structure. The adhesive prevents any tendency for the installed panel, especially the central portion thereof, to vibrate with respect to the supporting structure. As will be explained more fully hereinafter, the air space between the installed panel and the supporting structure accomodates the adhesive while maintaining the set distance between the composite panel and the supporting structure.

The resulting construction has exceptionally good insulating qualities. An air space is provided behind every panel to prevent the growth of mold and mildew that are common in such constructions in which the foamed plastic is applied directly to the supporting structure. A synergistic increase in the insulation value of the construction is obtained by providing a radiation-reflective foil surface on the foamed plastic side of each composite panel which faces the air space. The foil surface also provides an excellent moisture vapor barrier which prevents a loss in insulative values when moisture vapor is allowed to infiltrate the foamed plastic material.

There are no nails, screws, or pins extending through the essentailly continuous sheet of insulation to establish heat conductive paths or "thermal shorts." The clips of the present invention represent only minimal heat conductive paths when compared to other constructions wherein nails, screws, or pins are driven through the assembly from the inside surface to the supporting structure. The insulation shield provided by the invention, forms an essentially non-interrupted envelope which affords exceptional insulation.

THE DRAWINGS

Embodiments representing the best mode presently contemplated of carrying out the invention are illustrated in the accompanying drawings, in which:

FIG. 1 is a fragmentary perspective view of a wall construction showing the special retaining clips of the invention securing composite wall panels to an exterior, brick, load-bearing wall;

FIG. 2, a vertical cross-sectional view taken on line 2—2 of FIG. 1;

FIG. 3, a fragmentary perspective view showing a modified version of the special retaining clip engaging an edge face of a composite wall panel and secured to a supporting wall;

FIG. 4, a front elevational view of the special clip of FIGS. 1 and 2.

FIG. 5, a bottom plan view of that clip;

FIG. 6, a fragmentary pictorial view of a roof construction showing special retainer clips of the invention as to secure the composite, foamed plastic, insulating panels to a metal roof deck; and FIG. 7, a fragmentary, vertical, cross-sectional view taken on the line 7—7 of FIG. 6.

DETAILED DESCRIPTION OF THE ILLUSTRATED EMBODIMENTS

Figure 1:
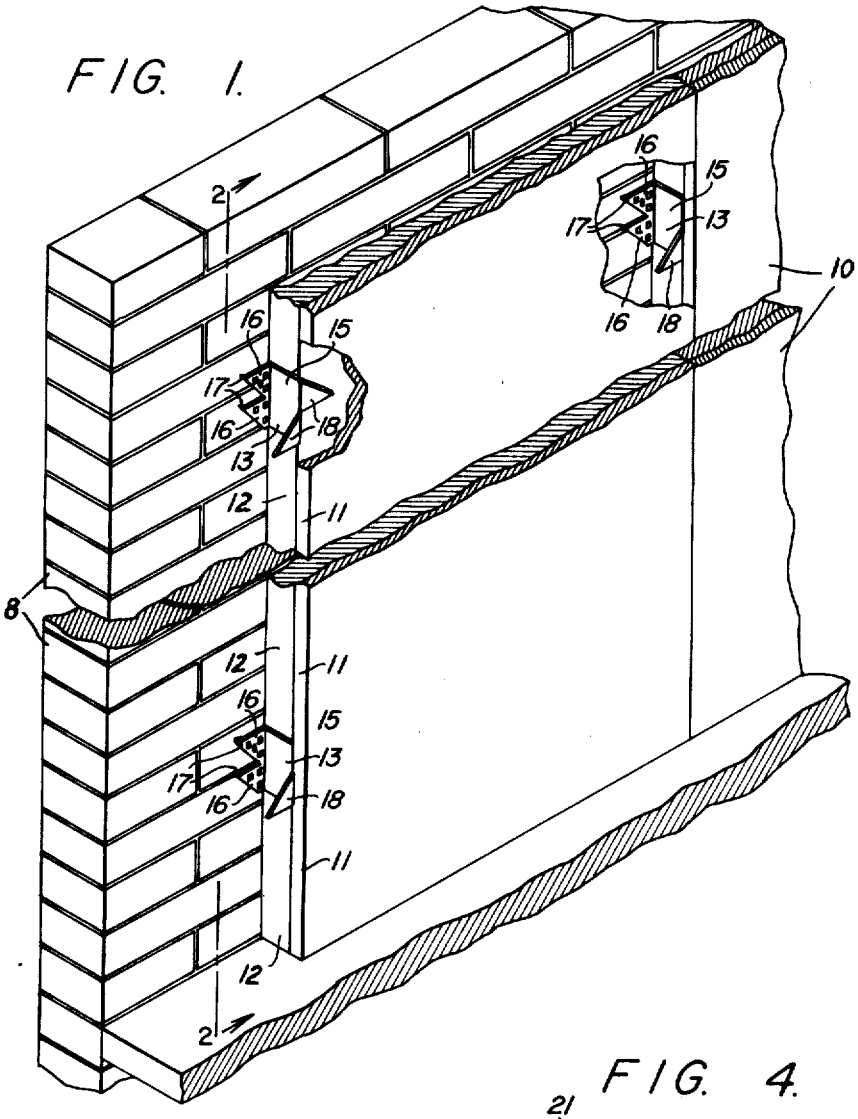
Figure 2:
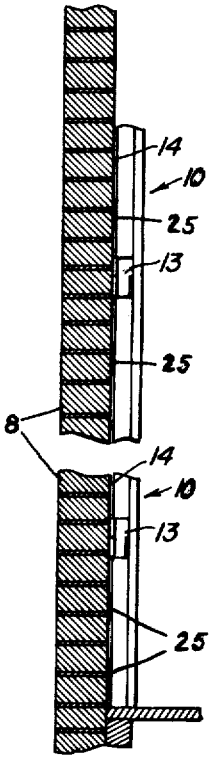

In the wall construction shown in FIGS. 1 and 2, a load-bearing supporting structure 8 is constructed of brick, but, so far as the invention is concerned, it could just as well be constructed of concrete blocks, poured or preformed concrete, metal, lumber, etc. Composite insulating panels 10 are positioned flatwise adjacent the inside face of the supporting structure 8.

Each of the composite panels 10 is made up of a rigid board facing 11 which is backed by a layer of foamed plastic insulation 12 adherent thereto. Such layer of foamed plastic insulation 12 can be formed as a separate sheet of material and then secured to the rigid board 11 with an adhesive, or a foam plastic such as polyurethane can be formed in-situ on the rigid board 11, in which case it serves as its own adhesive and no other bonding substance is needed. The rigid board facing 11 is commonly ordinary gypsum wallboard.

The composite panels are secured to the supporting structure 8 and held in place, edge-face to edge-face, by special retaining clips 13, which are advantageously stamped and bent to final shape from galvanized sheet steel. The clips 13 also serve to accurately space the composite panels 10 from the supporting structure 8 to form an air space 14, FIG. 2, therebetween, as well as to assure flush registry of the broad panel faces so that the finished wall faces of the composite panels 10 will be smooth and without irregularities in surface contour.

Figure 5:
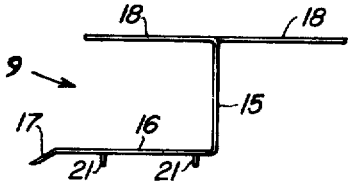

In accordance with the invention, the retaining clip 13 comprises a flat web strip 15 having flanges extending perpendicularly from the lateral edges thereof to provide a securement flange 16 at and along one edge of the web strip 15 and panel anchoring, prong flanges 18 extending mutually oppositely at and along the other edge of the web strip. The securement flange 16 is adapted to be secured flatwise against the face of the supporting structure, such as the brick wall 8 shown in FIG. 1-3 or the metal roof decking 19 shown in FIGS. 6 and 7, so that the web strip 15 extends essentially perpendicularly from the supporting structure. The outer edge of the securement flange 16, i.e. its free terminus, is turned outwardly of, or otherwise deflected away from the web strip 15, to provide an entry ramp 17 for the receiving pocket 9, FIG. 5, defined between the securement flange 16 and the corresponding anchor flange 18.

Figure 3:
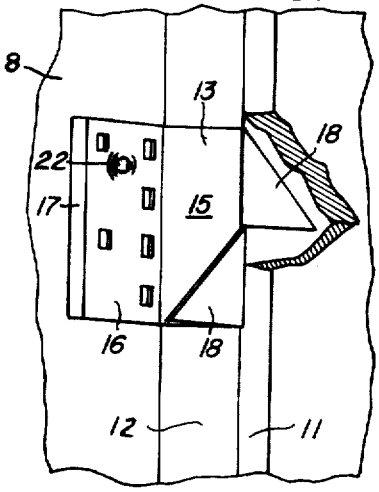
Figure 4:
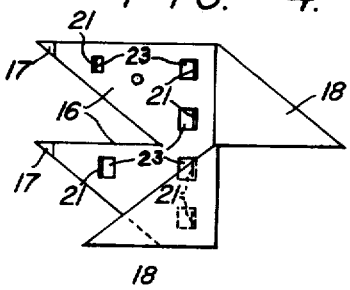
Figure 6:
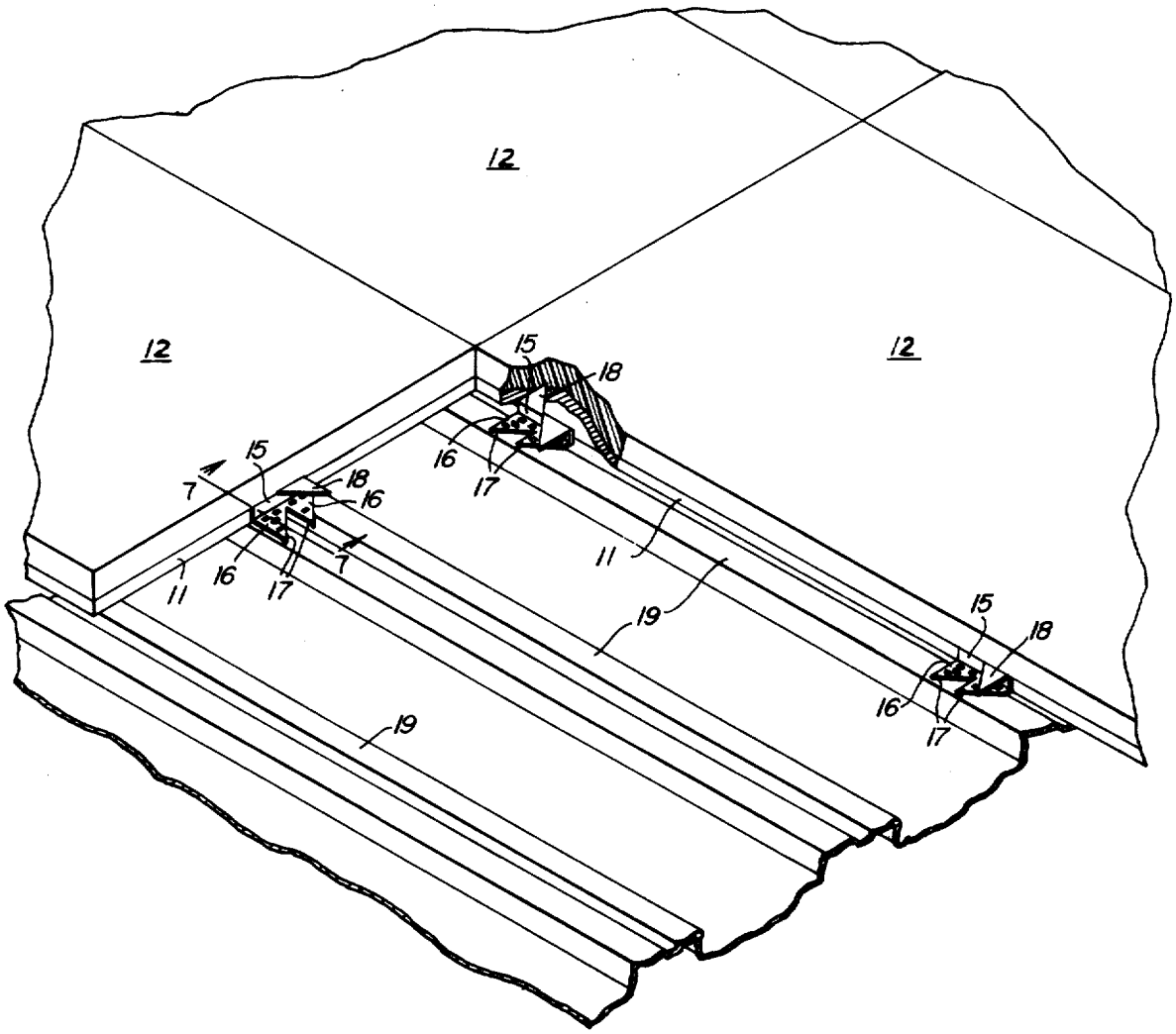
Figure 7:
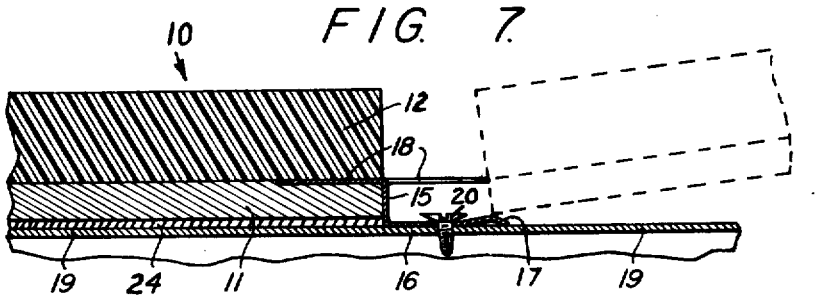

The width of the web strip 15 depends upon how the panels are installed in a particular construction, i.e. whether with the foamed plastic layer or with the rigid board facing being closest to the supporting structure. For most walls and ceilings the composite panels 10 are installed, as shown in FIGS. 1-3, with the foamed plastic layer facing closest to the supporting structure 8. In such applications, the width of the web strip 15 is commensurate with the thickness of the foamed plastic layer. When the composite panels are used as roof deck insulation, the rigid board facing is advantageously made of a fire resistant material such as fire-rated gypsum board, and the panels are customarily applied over the steel roof decking with the fire-resistant, rigid board facing of the panels positioned adjacent the steel deck as is shown in FIGS. 6 and 7. In such applications, the thickness of the web strip 15 is commensurate with the thickness of the rigid board facing.

Besides directing the edgewise installation of a to-be-positioned panel relative to one already positioned, the ramp 17 effects proper spacing of the thereby positioned marginal edge portion of the panel from the supporting wall 8. As can be seen from FIG. 7, when the clip 13 is secured to the supporting structure, such as the metal roof decking 19, the ramp 17 forms an advantageous guide for lifting the edge of the to-be-installed panel, shown in phantom, upward as such panel is moved edgewise into abutting relationship with the previously installed panel. The lifting action raises the edge of the to-be-installed panel to an exact positioned for the panel anchoring, prong flanges 18 of clip 13 to penetrate the foamed plastic layer at its interface with the rigid board facing of such panel.

A preferred variation of the clip 13, is shown in FIGS. 1-5, wherein in addition to the ramp 17, the clip is provided with spacer projections 21 (FIGS. 4 and 5) extending from the securement flange 16 in the same direction as ramp 17. The depth of the projections 21 are the same as that of ramp 17 i.e. the tip ends of the spacer projections 21 are all in a plane which is parallel to the securement flange 16 and contains the outer edge of the ramp 17. The spacer projections 21 are adapted to maintain the body portion of securement flange 16 properly spaced from the supporting wall 8 and substantially parallel therewith when the clip 13 is attached thereto.

Clips 13 having the spacer projections 21 are especially useful when composite insulation panels 10 are being installed against a wall, as in FIGS. 1-3. In such applications, the foamed plastic portion 12 of the panel 10 is normally installed adjacent the supporting wall 8. The securement flange 16 of a clip 13 provided with spacer projections 21, serves as a flat receiving surface for the foamed plastic layer 12 of the panel 10. The ramp formation 17 lifts the leading edge-face of the next panel being installed from the wall structure 8 as the panel is moved into abutting relationship with the previously installed panel. The edge of the panel being installed slides smoothly on the flat portion of the clip 13 and into proper contact with the anchor flange 18.

When a powder driven attachment tool, such as nailing "gun" which use the equivalent powder charge of a 22 caliber shell to drive the nail into the structure, is used to attach the clip 13 to a supporting structure such as concrete, the shock exerted on the securement flange 16 is, in many instances, sufficient to distort that flange, and when no spacer projections 21 are provided, the shock exerted by the power tool is transmitted to and may result in deformation of the web strip 15. The transmission of the shock to the web strip can be eliminated, or at least reduced so that no distortion of the web strip 15 occurs, by providing the securement flange 16 with the spacer projections 21. A small area of the body of the securement flange 16 around the powder-driven nail 22, FIG. 3, and between the spacer projections 21 is deformed and pushed downwards towards the wall structure, but the securement flange 16 as a whole remains relatively unaffected, i.e. the larger portion of the flange 16 remains relatively flat. The deformation of the small area around the nail or screw acts to absorb the shock exerted by the impact of the power tool, and insufficient shock is transmitted to the web strip 15 to distort it. In addition, the nail or screw head is inset in the depressed area, so that it does not project above the surface of the flange to hinder the sliding of the panel thereover.

The relatively flat area of the securement flange 16 provides a sufficiently broad receiving surface for the foam portion of the panel to prevent damaging the foamed plastic layer which contacts the clip 13. When the rigid board side of the panel, rather than the foam plastic side, is positioned next to the supporting structure 8, as shown in FIGS. 6 and 7, the securement flange 16 need not be provided with the spacer projections. In such applications, there is no advantage in maintaining the body of flange 16 in relatively flat condition, because the rigid board is substantially incompressible, and contact with the ridge formed by the ramp 17 will not result in any damage of the board. The attachment screw 20, FIG. 7, used to secure clips which are not provided with spacer projections should be installed manually or by an air or electrically driven tool to avoid deforming the web strip. As shown in FIG. 7, when there are no spacer projections provided, the ramp 17 forms a ridge which lifts the edge of the to-be-installed panel (shown in phantom) to the level of the head of the attachment screw 20 so that the panel can easily slide over it. As pointed out hereinbefore, the ramp also effects the correct positioning of the to-be-installed panel for engagement with the prong of anchor flange 18, to guarantee flush alignment of the to-be-installed panel with the previously installed panels.

The ramp 17, either by itself or in combination with the spacer projections 21, insures a uniform air space 14, FIG. 2, between the composite panel 10 and the supporting wall 8. This space permits air to slowly circulate in turbulent manner rather than laminar flow behind each panel, thereby preventing the growth of mold and mildew which is common in constructions where the foamed plastic is applied directly to the supporting wall. In addition, it has been found advantageous to use a construction adhesive together with the clips to secure the composite panels 10 to the supporting wall 8. The adhesive is placed, either as a series of ribbons or beads, or a plurality of spots, on the face of the to-be-installed panel which, when installed is adjacent to the supporting structure. The air space 14 permits the adhesive 25, FIG. 2, to spread out, and make good contact with both the supporting wall 8 and the inside face of the panel 10. By allowing the adhesive 25, to spread out in the air space 14, thick accumulations of adhesive is avoided thus insuring that the panel 10 will be uniformly spaced from the supporting wall 8. The adhesive 25, especially when applied to the control portions of the panels 10, prevents any tendency for the installed panel to vibrate or oscillate in a direction perpendicular to the support wall 8.

When applying panels on a roof, such as illustrated in FIGS. 6 and 7, the space between the panels 10 and the steel deck 19 is advantageously filled with an adhesive 24, such as asphalt or coal tar.

It has been found preferably for the ramp portion 17 to slope downward from the flange 16 at an angle of about 35°, with the end of the ramp 17 being at least 0.10 inch below the body of flange 16. The ends of the spacer projections 21 should be the same distance below the body of flange 16 as the end of the ramp, i.e. the end of the ramp 17 and the ends of the spacer projections 21 all lie in a plane which is parallel to the flange 16 and positioned at least 0.10 therefrom. The securement flange 16 can have various shapes such as the sawtooth shape shown in FIGS. 1,2, and 4, or the solid flat shape as shown in FIG. 3.

The spacer projections 21 are conveniently formed during the stamping and bending of the clip 13. As the clip is stamped from a metal blank, the portion thereof corresponding to the securement flange 16 is stamped so as to form a plurality of "U" shaped cuts therein. The "U" shaped portions are then bent downward to make the spacer projections 21 and leave a corresponding series of openings 23, FIG. 4.

Installation of the composite wallpanels to the supporting wall structure, can be started at either an inside or outside corner; however, it is preferable to start from an inside corner. Several clips are attached to the supporting structure adjacent the corner thereof. If the corner is an inside corner, the clips are attached to the wall so that the flat web strip 15 of each clip is positioned flatwise against the joining wall and the securement flange 16 of each clip extends from the corner flatwise against the wall to which the panel is to be applied. The anchor flanges 18 of the clips which are installed in an inside corner must be modified. The anchor flange 18 which normally extends from the flat web strip 15 in an opposite direction of the securement flange 16, must be either bent into a position flush with the flat web strip 15 or into a position extending from the web strip in the same direction as the other anchor flange. The wallpanel which is to be installed is placed flatwise against the wall and moved along the wall so that its leading edge approaches the corner and the clips therein. The edge of the wallpanel slides up the ramp formation 17 and then engages the extending prongs of anchor flanges 18 of the clips. The ramp formation lifts the edge of the wallpanel to the proper position for the prongs of anchor flanges 18 to penetrate the foamed plastic layer 12 at the interface of that layer and the rigid board 11. Several clips 13 are then secured to the exposed wall. Each of these clips 13 are secured to the edge of the wallpanel by driving one of the mutually oppositely extending anchor flanges 18, namely the one which extends from the web strip 15 in a direction opposite to that of the securement flange 16, into the foamed plastic layer 12 at the interface of that layer and the rigid board. When the clips 13 are properly attached to the edge of the wallpanel, the securement flanges 16, which extend from the edge of the wallpanel, are securely attached flatwise to the wall.

Installation of subsequent wallpanels is accomplished in a similar manner. The next wallpanel is placed flatwise against the wall and moved towards the previously installed wallpanel and into engagement with the clips thereon.

When more than one row of panels are needed to cover the supporting structure, such as on high walls and on roofs, a somewhat modified installation procedure is used. The modified procedure will be described with reference to FIGS. 6 and 7 which show two rows of panels as being applied on a roof, with the roof decking being the supporting structure to which the panels are secured. However, the procedure for installing multirows of panel units is the same whether the panels are applied to vertically standing walls or to roofs.

Installation of the first row of panels is made using basically the same method as described above. When a second or subsequent row of panels is installed adjacent a previously installed row, each panel of the subsequent row is attached by means of clips 13 to the corresponding panel in the previous row as well as to the adjacent panels in the same row. Thus, during the installation of each panel in the subsequent rows, one side of the panel is attached to a panel in the previous row while a second side of the panel is attached to the previously applied panel in the same row.

Preferably, the panels in each row are installed with their longitudinal dimension being in line with the row being installed. As each panel in the first row is installed, clips 13 are attached to the longitudinal edge thereof which will abut the subsequent row of panels, as well as to the opposite end edge which will abut the next panel in that row. The clips 13 are attached to the panels in the same manner as described hereinbefore. The panels in subsequent rows are installed by installing clips 13 along the two edges of the panel which, when positioned, will not abut any of the previously installed panels. Preferably, two or more clips 13 are attached to the longitudinal edge and one clip is centered in the end edge of the panel. The end of the panel having no clip is placed flatwise against the supporting structure, such as the roof decking 19 in FIG. 6, while the other end of the panel is held slightly above the supporting structure. The end of the panel having no clip becomes the lead edge, and the panel is moved so that the lead edge slides into engagement with the clip 13 on the end of the previously installed panel in that row. The other end of the panel is then swung away from the previously installed row of panels just enough so that the panel clears the clips 13 on that row. The panel which is being installed is set flatwise on the support structure and slid into engagement with the clips 13 on the row of previously installed panels. Additional panels are installed by repeating the above steps.

In some applications, such as where the building codes require that the wall panels are capable of remaining in place on the supporting structure even in the event of a fire, screws, nails, etc. can be driven through the rigid board 11 and into the flanges 18. By using such fasteners, the panel 10 will remain securely attached to the supporting wall even though the fire may degrade or otherwise harm the foamed layer 12 of the panel.

Whereas this invention is here illustrated and described with particular reference to preferred specific embodiments thereof, it should be understood that various modifications of such embodiments may be made without departing from the invention as particularly pointed out in the claims that follow.

We claim:

1. Panel building construction, comprising a supporting structure in the nature of a wall, ceiling, or roof structure having a panel-receiving face comprising a substantially flat surface; retainer clips for composite insultating panels each of said clips having a flat web strip and flanges extending from opposite lateral edges thereof, said flanges including a securement flange extending from one of the lateral edges of the web strip substantially perpendicular to the web strip, and a pair of flanges extending mutually oppositely from the other lateral edge of the web strip substantially perpendicular to the web strip, the securement flange having its free terminus turned outwardly of the web strip to provide an entry ramp for a receiving pocket defined between that flange and the corresponding flange of said pair of flanges; fastener means rigidly attaching the securement flanges of said retainer clips to said flat surfaces of the supporting structure with their free termini resting on said flat surfaces and providing entry ramps; and composite insulating panels fitted into and held by the retainer clips edge-face to edge-face with the web strips therebetween, said panels each comprising a rigid board facing backed by a layer of foamed plastic insulating material adherent thereto, the said pair of oppositely extending flanges of each clip penetrating said insulating material of adjoining panels at and along respective interfaces between the rigid board facings and the layers of said insulating material thereof, with either said layer or said facings of one of said adjoining panels fitting into the receiving pockets of the corresponding clips and spaced from the supporting structure by the entry ramps thereof.

2. Panel building construction in accordance with claim 1, wherein the securement flanges of the retainer clips have spacer projections extending therefrom outwardly of the web strips.

3. A method of building construction utilizing composite insulating panels each made up of a rigid board facing backed by a layer of foamed plastic insulating material adherent thereto and retainer clips each comprising a flat web strip having flanges extending from opposite lateral edges thereof, said flanges including a securement flange extending perpendicularly from one of the lateral edges of the web strip substantially perpendicular to the web strip, and a pair of flanges extending mutually oppositely from the other lateral edge of the web strip substantially perpendicular to the web strip, the securement flange having its free terminus turned outwardly of the web strip to provide an entry ramp for a receiving pocket defined between the securement flange and the corresponding flange of said pair of flanges, at least one of the retaining clips having its securement flange secured flatwise against an essentially flat supporting structure so that the web strip extends perpendicularly therefrom with said pocket open for receiving one of the composite insulating panels edgewise; installing one of said composite panels by pushing it edgewise into the open pocket of said clip so it will ride up said entry ramp and abut against this web strip of said clip, the said corresponding flange of said clip penetrating the foamed plastic layer of the panel at the interface of that layer and the rigid board facing; securing at least one additional retainer clip to the opposite edge face of the panel by driving the flange of said pair of flanges which extends opposite of said pocket into the foamed plastic layer of the installed panel at the interface of that layer and the rigid board facing of the panel so that the web strip abuts against the edge face of the installed panel and so that the pocket of said additional clip is open for receiving an additional composite panel; securing the securement flange of said additional clip flatwise against the essentially flat supporting structure with its entry ramp in position for deflecting said additional panel into the open pocket of said additional clip; installing said additional panel in a manner similar to the first; and continuing to similarly install additional retainer clips and additional composite panels in like manner.

4. A method in accordance with claim 3, wherein a construction adhesive is applied to the to-be-installed panel on the face thereof which, as installed, will be adjacent the supporting structure.

5. A clip for mechanically securing composite panels, edge-face to edge-face, to supporting structure in the nature of a wall, ceiling, or roof structure having a panel-receiving face comprising a substantially flat surface, said panels each having a rigid board facing backed by a layer of foamed plastic insulating material, said clip comprising a flat web strip having flanges extending substantially perpendicularly from opposite lateral edges thereof, said flanges including a securement flange at and along one edge of the web strip and a pair of flanges extending mutually oppositely at and along the other edge of the web strip, said securement flange being adapted to be rigidly secured, flatwise, to said panelreceiving face of the supporting structure and having its free terminus turned outwardly of the web strip to provide, when so secured, a entry ramp for a receiving pocket defined between the securement flange and the corresponding flange of said pair of flanges.

6. A clip in accordance with claim 5, wherein the securement flange is provided with a plurality of spacer projections extending therefrom outwardly of the web strip.

7. A clip in accordance with claim 6, wherein the free end of the terminus of the securement flange and the free ends of the spacer projections are equidistant perpendicularly from the plane of said securement flange, the distance being at least about 0.1 inch.

8. A clip in accordance with claim 5, wherein the terminus of the securement flange is turned out at an angle of about 35° with the plane of the body of said securement flange.

9. A clip in accordance with claim 8 wherein the securement flange is provided with a plurality of spacer projections extending therefrom outwardly of the web strip.

* * * * *